US006247342B1

(12) United States Patent
Lilas

(10) Patent No.: US 6,247,342 B1
(45) Date of Patent: Jun. 19, 2001

(54) LOCK WITH LATCH BOLT FOR DOOR OR WINDOW

(75) Inventor: André Lilas, Sarrebourg (FR)

(73) Assignee: Ferco International Ferrures et Serrures de Batiment, Reding (FR)

( * ) Notice: Subject to any disclaimer, the term of this patent is extended or adjusted under 35 U.S.C. 154(b) by 0 days.

(21) Appl. No.: 09/310,299

(22) Filed: May 12, 1999

Related U.S. Application Data

(63) Continuation-in-part of application No. PCT/EP98/00264, filed on Jan. 19, 1998.

(30) Foreign Application Priority Data

Jan. 22, 1997 (DE) ..... 297 01 070 U

(51) Int. Cl.[7] ..... E05B 55/00

(52) U.S. Cl. ..... 70/106; 70/143; 292/39; 292/140; 292/150; 292/165; 292/170

(58) Field of Search ..... 70/106, 143; 292/140, 292/165, 169, 170, 39, 150

(56) References Cited

U.S. PATENT DOCUMENTS

| | | | | |
|---|---|---|---|---|
| 1,553,947 | * | 9/1925 | Lindberg | 70/143 |
| 2,370,370 | * | 2/1945 | Neer et al. | 292/165 X |
| 3,828,592 | * | 8/1974 | Horgan, Jr. | 70/134 |
| 4,691,542 | * | 9/1987 | Young | 70/129 |
| 4,691,543 | | 9/1987 | Watts | 70/143 |
| 5,290,077 | | 3/1994 | Fleming | 292/35 |

FOREIGN PATENT DOCUMENTS

| | | |
|---|---|---|
| 0 466 677 | 1/1992 | (EP) . |
| 2 203 414 | 5/1974 | (FR) . |
| 2 439 283 | 5/1980 | (FR) . |
| 2 540 170 | 8/1984 | (FR) . |
| 2 215 770 | 9/1989 | (GB) . |

* cited by examiner

*Primary Examiner*—Lloyd A. Gall
(74) *Attorney, Agent, or Firm*—Alix, Yale & Ristas, LLP

(57) ABSTRACT

A lock with a latch bolt (41) has a translating part (65), which can be moved by a hub which can be turned by a button and/or key operation so that it controls an additional extension of the latch bolt (41) into a locking position and blocks the latch bolt in this locking position.

13 Claims, 3 Drawing Sheets

LOCK WITH LATCH BOLT FOR DOOR OR WINDOW

RELATED APPLICATION

This application is a continuation-in-part of International Patent Application No. PCT/EP98/00264 filed Jan. 19, 1998.

FIELD OF INVENTION

The invention concerns a lock with a latch bolt for a door or a window.

BACKGROUND OF THE INVENTION

The latch bolt of a door lock serves to latch the door automatically when the door is closed and to hold the door in the closed position. The latch bolt can be retracted into the lock from its normal position against spring pressure in order to release the door. This retraction of the latch bolt can be caused by a button-actuated hub and/or by a key-operated element, e.g. a lock cylinder, via appropriate mechanical elements. Such a latch bolt does not have an anti-burglary function, such as, e.g., as is exerted by a key-operated bolt of the lock. On the one hand, the amount of its projection into the strike plate on the door or window frame is too little for this, on the other hand a latch bolt easily can be pushed back into the lock against the spring force from outside by means of a suitable instrument, which for example acts on the inclined surface of the latch bolt.

SUMMARY OF THE INVENTION

The object of the invention is to design a lock of the above-mentioned kind so that the latch bolt also has a burglary prevention function, preferably with the anti-burglary function corresponding to a key-operated bolt.

In the case of the lock in accordance with the invention, a translating part can be moved by turning the hub in the direction opposite the opening direction so that it moves the latch bolt out of its normal position by an additional amount out of the lock, so that it extends into the strike plate on the side of the door or window frame with a sufficient depth of penetration. Preferably the latch bolt is blocked against being drawn into the lock in this extended position.

BRIEF DESCRIPTION OF THE DRAWINGS

One embodiment of the invention is explained in greater detail by means of the drawings. Here.

DETAILED DESCRIPTION OF A PREFERRED EMBODIMENT

Figure 1:
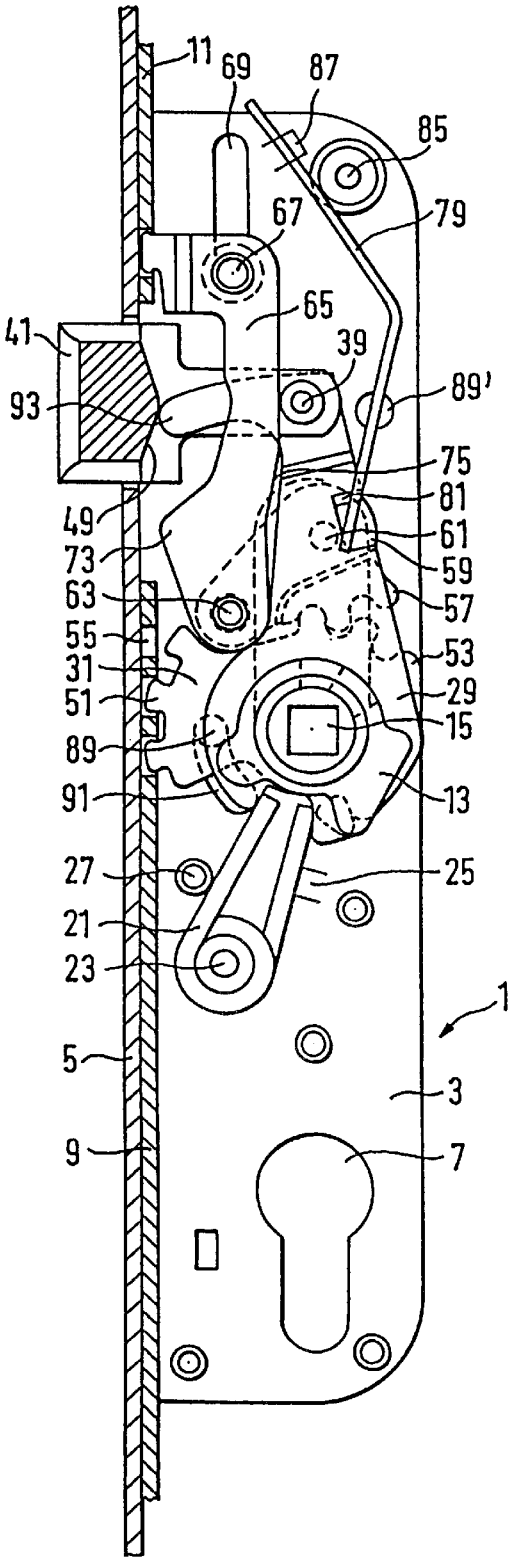
FIG. 1 shows a schematic representation of the lock in accordance with the invention in the normal position, with an opened lock housing and partially in a cross-section.
Figure 2:
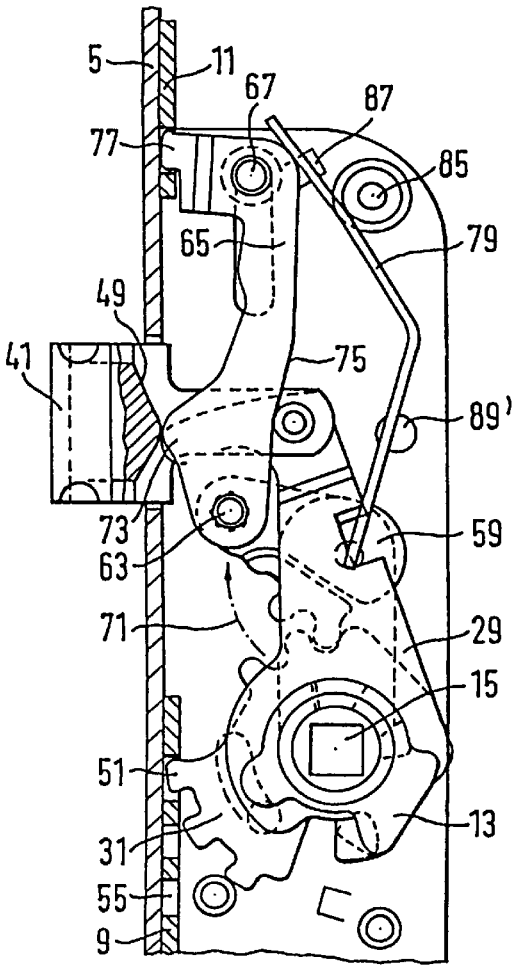
FIG. 2 shows the upper part of the lock in the locked position in a representation similar to that of FIG. 1.

The lock shown in FIG. 1 is specified for use in the vertical jamb of a door or window wing frame and in particular is suited for use in wing frames, the jambs of which consist of metal or plastic sections, however it also can be used with wooden windows or doors. Only the rear side wall 3 as well as the groove-side front wall or selvage 5 of the lock housing are shown in drawing. An opening for the insertion of a lock cylinder is indicated at 7. The side wall 3 of the lock housing has numerous openings, projections, pins, and the like, which serve for holding the lock housing together and for positioning or guiding the movable parts of the lock, of which, however, FIG. 1 and FIG. 2 show only those which are necessary for the understanding of the invention.

The lock shown is a connecting rod lock, that is, below the selvage 5 there are movably mounted two connecting rods 9, 11 which can be moved out of the opening position shown in FIG. 1 into a locking position, in which they in a known way cause the locking of the door or window wing provided with the lock on the frame in interaction with strike plates or lock recesses on the frame side. However, the presence of the connecting rods 9, 11 is not absolutely necessary for the invention; the invention also can be applied in the case of a lock which does not have any connecting rods or has only a single connecting rod.

Figure 4:
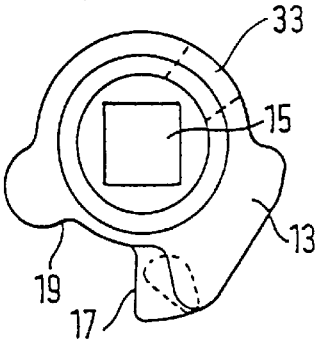
Figure 4A:
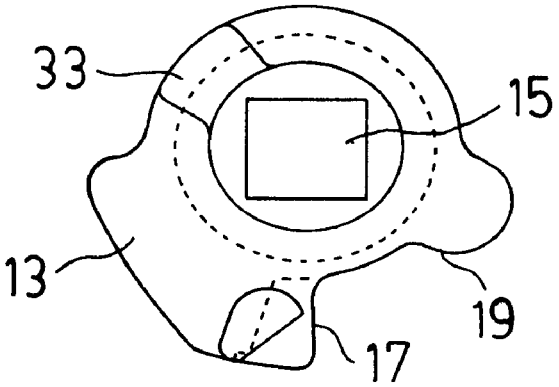

A hub 13, which is shown in FIG. 4 from the front side and in FIG. 4*a* from the back side, is mounted capable of turning in the lock housing. The hub 13 has a rectangular opening 15 for insertion of a button pin. Spring stop surfaces 17, 19, between which the arms of a fork-shaped spring 21 engage, are formed by projections on the circumference of the hub 13. The spring 21 is mounted on a bearing pin 23 fixed to the housing, and its arms lie against two stops 25, 27 fixed to the housing. Therefore the spring 21 hosts the hub 13 at a definite angular position (normal position), from which the hub can be turned by button operation in one direction of turning (opening direction) or in the opposite direction, in each case then one of the two arms of the spring 21 moves away from the pertinent stop 25, respectively 27.

Figure 5:
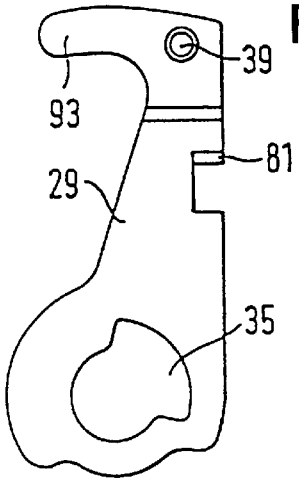
Figure 6:
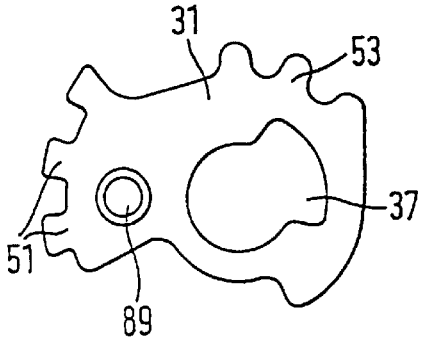

Coaxial to the hub 13, and independent of the latter, there are two further elements mounted in the housing, namely a latch bolt control arm 29, which is shown in FIG. 5, and a gear 31, which is shown in FIG. 6, the latch bolt control arm 29 lying between the hub 13 and the gear 31. On the rear side of the hub 13 (shown in FIG. 1) there is an axially projecting cam 33, which engages in sector-shaped cut-outs 35 and 37 of the latch bolt control arm 29, respectively of the gear 31, so that they are pivoted when the hub 13 turns. The sector-shaped cut-out 35 of the latch bolt control arm 29 extends over a larger angle than the sector-shaped cut-out 37 of the gear 31, and the latter again over a larger angle than the cam 33 of the hub 13. This has the consequence that the hub 13, if it can be turned in accordance with FIG. 1 in one direction of rotation or another, and thus has moved the latch bolt control lever 29 and/or the gear 31 with it, can be returned to the normal position by means of the spring 21, without moving the latch bolt control lever 29 or the gear 31 with it.

The latch bolt control lever 29 is connected on its end via a pivot pin 39 with a latch bolt 41, which is mounted capable of moving horizontally in the lock housing, and projects out of an opening in the selvage 5, in order to interact with a strike plate of the frame (not shown).

Figure 3:
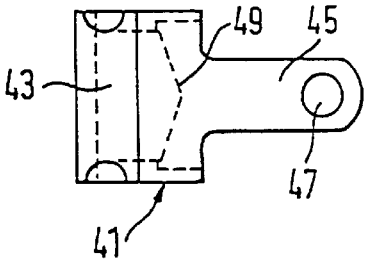
Figure 3A:
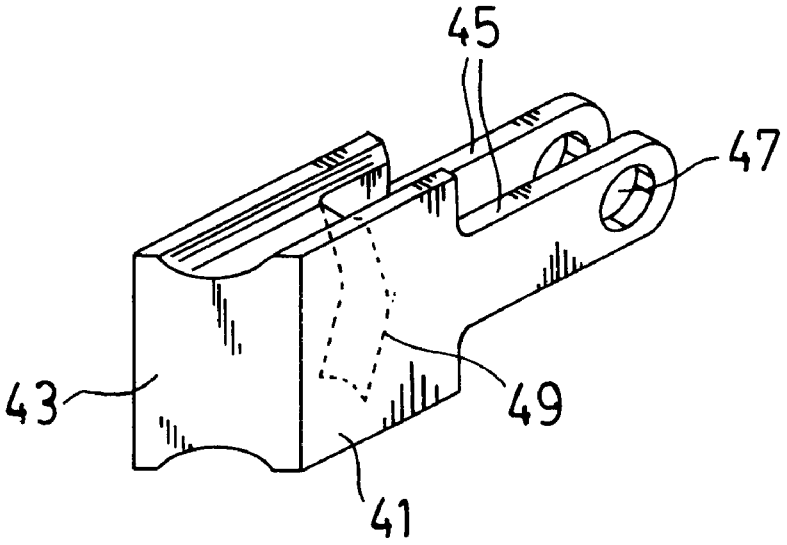

The latch bolt is shown in FIG. 3 in a side view and in perspective in FIG. 3A, and has a latch body with a slanted front surface 43 as well as two legs 45 projecting to the interior of the lock, in which openings 47 for receiving the pivot pin 39 are made. Between the legs 45 there is formed on the latch an inclined surface 49 directed toward the interior of the lock, or as the case may be, toward the latch bolt control arm 29, which is made rising at a slope from its upper and lower end in the direction toward the legs 45, and in its middle reaches an apex. This symmetrical design of the inclined surface 49 serves for the purpose of being able to mount the same latch bolt in two positions rotated by 180° in the lock, so that the lock can be used for a door or window wing attached on the right or left.

If it is not necessary to use the latch bolt for right or left attachment, the inclined surface 49 also can be designed so that it rises at a slope from the lower end passing in the direction toward the legs 45. The function of the inclined surface 49 is explained further below.

Figure 8:
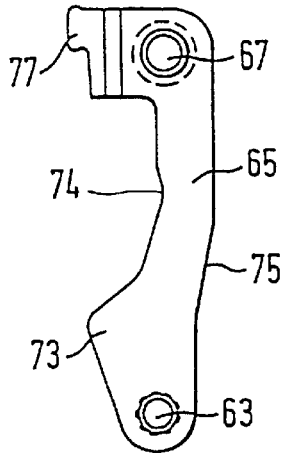
FIGS. 3 to 8 show individual representations of the components of the lock in accordance with FIG. 1 and FIG. 2 important for the understanding of the invention.
Figure 7:
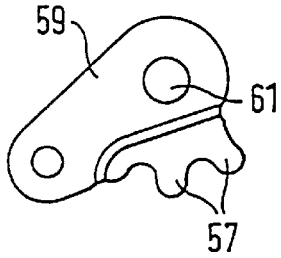

The gear 31, which is mounted coaxial to the hub 13, and can be turned by the cam 33 thereof, has two groups of teeth 51 and 53. The teeth 51 engage in appropriately designed openings 55 of the lower gear rack 9, in order to move the latter. The teeth 53 engage in correspondingly designed teeth 57 of a driving lever 59 (FIG. 7), which is mounted capable of turning in the lock housing by means of a bearing pin 61. The free end of the driving lever 59 is connected hinged with the lower end of a translating part 65 (FIG. 8) by means of a pivot pin 63. On its upper end the translating part 65 is guided capable of moving in a guide slot 69 of the rear lock side plate 3, running vertically in a straight line, by means of a guide pin 67 projecting on its rear side. Thus the translating part 65 is movable in the lock in an essentially vertically directed translational motion. However, since the pivot pin 63 moves on an arc-shaped path during the rotation of the drive lever 59, which path is indicated as 71 in FIG. 2, an additional horizontal component directed toward the latch bolt 41 is superimposed on the vertical motion of the translating part 65.

The edge of the translating part 65 turned toward the latch bolt 41 is profiled so that it has a projecting nose 73, which represents an active part which interacts with the inclined surface 49 of the latch bolt 41. This nose 73 causes the latch bolt 41 to be pushed out into a locking position when the translating part 65 moves upward, and, in the upper position of the translating part 65, blocks the latch bolt against being pushed back.

Above the nose 73 the section of the front edge of the translating part 65 springs back sufficiently, in a given case with the formation of a small recess 74, in order to permit the free motion of the latch bolt 41 out of the normal position into the opening position, when the translating part 65 is located in the position in accordance with FIG. 1.

The edge of the translating part 65 turned away from the latch bolt 41 (the right edge in FIG. 1) is profiled so that it is in contact with the pivot pin 39, a slanting section 75 of this edge representing an active part, which, in the case of the downward motion of the translating part 65 in combined action with the pivot pin 39, forces the retraction of the latch bolt 41 out of the extended locking position into the normal position.

Further, a tooth 77, which engages into an appropriate opening of the upper connecting rod 11 in order to displace the latter, is formed on the upper end of the translating part 65.

The latch bolt control lever 29 is spring-loaded by means of the extended arm of a spring 79, which lies against an upturned stop 81 on the latch bolt control lever 29. The spring 79 is wound in one or more screw windings around a bearing pin 85 attached in the lock housing, and its other arm is clamped tight in a recess 87 of the side wall 3 of the lock housing. The latch bolt control lever 29, and thus also the latch bolt 41, are spring-loaded in the direction of projection by means of the spring 79, and the pivot pin 39 is held in contact with the rear edge of the translating part 65 by the force of the spring 79.

A projecting pin 89, which engages in an arched slot 91 in the rear side wall of the lock 3, is molded on the rear side (seen in FIG. 1 and FIG. 6) of the gear 31. The angular deflection of the gear 31 is limited by the interaction of the pin 89 with the slot 91.

A nose 93, projecting toward the latch bolt 41, which is in contact with the inclined surface 49 of the latch bolt 41, and approximately at the apex of the inclined surface 49, is molded on the upper end of the latch bolt control lever 29. This nose 93 has no function for the operation of the lock, but serves only as an assembly aid. In the factory production of the lock, first all lock components with the exception of the latch bolt 41 are mounted in the lock housing, and the lock housing then is closed. Then the latch bolt 41 is pushed into the lock housing through the opening provided in the selvage 5, and indeed in the desired position for right hand or left hand use of the lock. At the time of pushing the latch bolt 41 into the lock housing, its inclined surface 49 comes in contact with the nose 93 of the latch bolt control lever 29 and carries this along until the bearing openings 47 on the legs 45 of the latch bolt 41 and the bearing openings 47 of the latch bolt control lever 29 are flush with one another and with the assembly openings 89' made in the side walls of the lock housing 1. Then the pivot pin 39 can be inserted through one of these assembly openings in order to connect the latch bolt control lever 29 and the latch bolt 41 pivoting with one another. If the user subsequently wishes to change the lock from right hand to left hand installation, he can loosen the latch bolt by removing the pivot pin 39 through the assembly opening 89', remove it from the lock, and reinsert it into the lock in the above-mentioned way in the reverse orientation.

The mode of operation of the lock in the case of opening and closing is as follows:

FIG. 1 shows the normal position, in the case of which the hub 13 is held by the spring 21 in its normal position or middle position by compressive engagement of the spring 21 between spring stop 27 and spring stop surface 17 on the hub 13. The translating part 65 is located in its lower position, the connecting rods 9, 11 are in the opening position. The latch bolt 41 is located in its normal position, in which it extends over the selvage 5 as far as is usual for the normal closing engagement in the strike plate on the side of the frame without additional locking function. This normal position of the latch bolt 41 is fixed by the contact of the pivot pin 39 with the rear edge of the translating part 65.

The hub 13 can be turned by button operation from this normal position indicated in FIG. 1 into the opening direction, that is, clockwise, and against the spring force of the spring 21, one arm of which in this case is raised from the stop 25. By this turning of the hub 13 in the opening direction, the latch bolt control lever 29 is swiveled clockwise against the force of the spring 79 via the cam 33 by means of which the latch bolt 41 is retracted in order to open the door. Because of the free travel of the projection 33 in the sector section 37 of the gear 31, in the case of this opening motion of the hub 13, the gear 31 is not carried along, and therefore the operating lever 59, the translating part 65, and the connecting rods 9, 11 remain at rest.

In the case of releasing the button, the force of the spring 21 returns the hub 13 to its initial position and the latch bolt lever 29, and thus the latch bolt 41, are returned to their normal position by the force of the spring 79. At the time of closing the opened door the inclined surface 43 of the latch bolt 41 runs onto the strike plate on the side of the frame, whereby the latch also is pushed into the lock against the force of the spring 79, in order to snap in behind the strike plate. Because of the sufficient angular dimension of the sector-shaped cutout 35 of the latch bolt control lever 29, in this case there is no motion of the hub 13 and the button connected with it.

If the hub is turned out of the normal or middle position shown in FIG. 1 into the closing direction by means of the button, that is, counterclockwise in FIG. 1, whereby the other arm of the spring 21 rises from the relevant stop 27, then the gear 31 is turned counterclockwise by the cam 33 of the hub 13, and causes, via the engaging teeth 53, 57, the operating lever 59 to turn in the clockwise direction, by means of which the translating part 65 is pushed upward. The lower connecting rod 9 is pushed into the locking position by the teeth 51 of the gear 31 and the upper rack 11 by the tooth 77 of the translating part 65. In the case of the upward motion of the translating part 65 the nose 73 thereof comes to lie against the inclined surface 49 of the latch bolt 41, whereby the latch bolt is pushed out of the lock to the left from its normal position shown in FIG. 1 by an additional amount so that it enters the strike plate on the side of the frame with a greater depth of projection. This projecting motion of the latch bolt 41 is supported by the horizontal component of the arched motion of the lower end of the translating part 65 corresponding to the arched path 71.

When the translating part 65 has reached its upper position or locking position, which is defined by the guide pin 67 lying on the upper end of the guide slot 69, then the nose 73 has been placed in front of the apex of the inclined surface 49 and blocks the latch bolt 41 in the locking position. The parts now are in the position shown in FIG. 2. FIG. 2 shows that the operating lever 59 has been swiveled out of the position shown in FIG. 1 so far that the swivel pin 63 now is higher than the bearing pin 61, that is, the operating lever 59 has passed through a dead point with respect to the force acting on it from the latch bolt 41. If an external horizontal force is exerted on the latch bolt 41 in the position shown in FIG. 2, in order to push it into the lock, then this force acts on the operating lever 59 via the nose 73 of the translating part 65 and the pivot pin 63 in the sense of a torque acting clockwise. However, when the guide pin 89 of the gear 31 lies against the lower end of the arched slot 91 of the housing wall 3, the gear 31 is blocked against further counterclockwise turning, and thus the operating lever 59 is blocked against further clockwise turning. This produces an effective blocking of the latch bolt 41 in the locking position.

After the described motion of the parts into the locking position shown in FIG. 2, the hub 13 can return to the normal or middle position under the force of the spring 21, whereby the remaining parts remain in the position shown.

When, starting from the locking position shown in FIG. 2, the hub 13 is turned in the opening direction, that is, clockwise, the gear 31 also is turned clockwise, whereby the operating lever 59 is turned counterclockwise and pulls the translating part 65 downward into the normal position. In the case of this downward motion the active part 75 on the rear (right) edge of the translating part 65 in combined action with pivot pin 39 controls a displacement of the latch bolt 41 to the right out of the locking position into the normal position shown in FIG. 1. At the same time the connecting rods 11, 9 are retracted into their opening position via the tooth 77 of the translating part 65 and the teeth 51 of the gear 31. However, as already mentioned, the connecting rods 11, 9 and thus also the elements provided for their operation, such as the teeth 77, 51, are not necessary features of the invention.

The embodiment of the lock in accordance with the invention shown in FIGS. 1 and 2 in a slightly enlarged scale is designed for a selvage 5 to hub 13 axis dimension of 28 mm, whereby the latch bolt in its normal position projects 10 mm out of the lock. In the case of the transition to the locking position in accordance with FIG. 2, the latch bolt is pushed out by an additional 4 mm, so that the latch bolt projects out of the lock by 14 mm in the locking position in order to achieve a depth of projection into the strike plate necessary for locking purposes. The amount of this additional latch bolt travel depends on the profiling of the translating part 65 in the area of its nose 73 and its rear active part 75. This profiling also can be changed so that an even greater additional travel of the latch bolt takes place in the case of an identical or greater selvage 5 to hub 13 axis dimension. Thus, for example, for a selvage 5 to hub 13 axis dimension of 35 mm an additional travel of 10 mm is possible, so that the latch bolt in the locking position projects over the selvage 5 by a total of 20 mm. In the case of increasing the selvage 5 to hub 13 axis dimension, it may be advisable to modify operating parts of the lock. For example, instead of the teeth 51, the gear 31 can have a further projecting arm, which is connected with the connecting rod 9 for operation thereof, e.g. by means of the connecting shoe.

The hub 13 also can be operated by a key instead of, or in addition to, the operation by means of a button, the rectangular pin of which engages in the rectangular opening 15, e.g. by means of a lock cylinder, which is mounted in the opening 7 of the lock provided for this, and the clamp of which is connected operationally with the hub, or also directly with the translating part 65. Drive arrangements with which the locking motion of the clamp of a lock cylinder can be transferred to a hub or a connecting rod translating part or the like are known in different embodiments, so that a detailed description and representation of them can be omitted in the drawings here.

What is claimed is:

1. A lock for door or window, said lock comprising:

a lock housing including a selvage having an opening;

a latch bolt, mounted for slidable movement in said lock housing, which in a normal position is held projecting out of said opening by a force exerted by a bolt spring and can be retracted into an opening position against the bolt spring force, a hub capable of turning, which is held in an initial position by a force exerted by a hub spring, and which is capable of turning against the hub spring force in an opening direction by means of an operator, a mechanical connection between the hub and the latch bolt such that by turning the hub in the opening direction, the latch bolt is retracted into the opening position against the bolt spring force, and a translating part which is capable of moving essentially at a right angle to the direction of motion of the latch bolt from an unlocked position to a locked position and is connected operationally with the hub, said translating part including a front edge facing toward said selvage and a rear edge facing away from said selvage, said front edge including an active part interacting with the latch bolt, wherein the rear edge of said translating part abuts said mechanical connection to define the normal position of said latch bolt when said translating part is in said unlocked position, and said translating part can be moved from said unlocked position into said locked position by turning the hub from its initial position in a direction of rotation opposite the opening direction and with this motion of the translating part the active part of the translating part forcibly pushes the latch bolt into an extended position in which the latch bolt projects out of the lock further than in the normal position.

2. The lock in accordance with claim 1, wherein when the translating part is in said locked position the active part of the translating part blocks the latch bolt against retraction.

3. The lock in accordance with claim 2, wherein the translating part has a second active part, which acts in combination with the latch bolt and causes the retraction of the latch bolt from the extended position into the normal position when the translating part is moved from its locked position by turning the hub in the opening direction.

4. The lock in accordance with claim 2, wherein the translating part is guided in the lock so that the motion of the translating part from the unlocked position into the locked position has a first motion component parallel to the direction of motion of the latch bolt, in addition to a second motion component directed at a right angle to the direction of motion of the latch bolt, said second motion component contributing to the extension of the latch bolt in the extended position.

5. The lock in accordance with claim 4, wherein one end of the translating part is guided by means of a guide pin in a guide slot of a lock housing, while the other end of the translating part is hinged to a lever mounted capable of turning in the lock housing, which lever is capable of turning by means of the hub via an operational connection.

6. The lock in accordance with claim 1, wherein the lock is a connecting rod lock and the translating part is coupled with a first connecting rod in such a way that said translating part controls a corresponding motion of the first connecting rod in the case of movement of the first connecting rod out of an unsecured position into a secured position and from the secured position to the unsecured position.

7. The lock in accordance with claim 1, wherein a rear side of the latch bolt turned toward the translating part has an inclined surface which rises obliquely from a lower end of the latch bolt in the direction toward the translating part for combined action with the active part of the translating part.

8. The lock in accordance with claim 7, wherein the inclined surface rises symmetrically from an upper and the lower ends of the latch bolt to an apex in the middle of the rear side of the latch bolt.

9. The lock in accordance with claim 1, wherein the hub is coupled with the latch bolt, which is mounted capable of turning coaxial to the hub and is connected capable of turning with the hub via a cam, the cam connection having a free travel, which makes it possible to push the latch bolt without motion of the hub.

10. The lock in accordance with claim 9, wherein the latch bolt has at least one arm projecting into a lock housing, on which the free end of the latch bolt control lever is hinged.

11. The lock in accordance with claim 1, wherein a driving part, which is mounted capable of turning coaxial to the hub and is coupled capable of turning with the hub via a cam, is provided for operating the translating part, the cam coupling having a free travel, which makes it possible to reset the hub into its initial position without resetting the translating part.

12. The lock in accordance with claim 11, wherein the driving part is a gear having teeth which are engaged with teeth of a lever mounted capable of turning, which lever is hinged with the translating part.

13. The lock in accordance with claim 11, wherein the driving part also is connected with a second connecting rod of the lock for the operation thereof.

* * * * *